US012768008B2

(12) United States Patent
Sisson et al.

(10) Patent No.: US 12,768,008 B2
(45) Date of Patent: *Oct. 20, 2026

(54) SEPARATION OF RARE EARTH ELEMENTS

(71) Applicant: SHINE Technologies, LLC, Janesville, WI (US)

(72) Inventors: Richard Sisson, Janesville, WI (US); Eric Van Abel, Janesville, WI (US); Thomas Drury, Janesville, WI (US); Charles Shackett, Janesville, WI (US); Greg Piefer, Janesville, WI (US)

(73) Assignee: SHINE Technologies, LLC, Janesville, WI (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/539,714

(22) Filed: Feb. 13, 2026

(65) Prior Publication Data

US 2026/0176719 A1 Jun. 25, 2026

Related U.S. Application Data

(63) Continuation of application No. 17/995,118, filed as application No. PCT/US2021/025439 on Apr. 1, 2021, now Pat. No. 12,584,193.

(Continued)

(51) Int. Cl.

*C22B 59/00* (2006.01)
*C22B 3/24* (2006.01)

(Continued)

(52) U.S. Cl.

CPC ..... *C22B 59/00* (2013.01); *C22B 3/24* (2013.01); *C22B 3/282* (2021.05); *C22B 3/36* (2021.05);

(Continued)

(58) Field of Classification Search

CPC C22B 59/00; C22B 3/24; C22B 3/282; C22B 3/36; C22B 3/42; C22B 9/02; C22B 9/04

See application file for complete search history.

(56) References Cited

U.S. PATENT DOCUMENTS 3,558,440 A 1/1971 Harris et al.
5,437,709 A 8/1995 Ellis et al.

(Continued)

FOREIGN PATENT DOCUMENTS

CN 101307384 A 11/2008
CN 101835914 A 9/2010

(Continued)

OTHER PUBLICATIONS

Chinese Office Action for Application No. 202180036283.3 dated Nov. 28, 2024 (24 pages with English translation).

(Continued)

*Primary Examiner* — Waqaas Ali

(74) *Attorney, Agent, or Firm* — Dinsmore & Shohl LLP

(57) ABSTRACT

A method for purifying lutetium includes providing a solid composition comprising ytterbium and lutetium and subliming or distilling ytterbium from the solid composition at a temperature of about 1196° C. to about 3000° C. to leave a lutetium composition comprising a higher weight percentage of lutetium than was present in the solid composition.

30 Claims, 2 Drawing Sheets

Related U.S. Application Data

(60) Provisional application No. 63/004,332, filed on Apr. 2, 2020.

(51) Int. Cl.

| | |
|---|---|
| ***C22B 3/28*** | (2006.01) |
| ***C22B 3/36*** | (2006.01) |
| ***C22B 3/42*** | (2006.01) |
| ***C22B 9/02*** | (2006.01) |
| ***C22B 9/04*** | (2006.01) |

(52) U.S. Cl.
CPC ..... *C22B 3/42* (2013.01); *C22B 9/02* (2013.01); *C22B 9/04* (2013.01)

(56) References Cited

U.S. PATENT DOCUMENTS

| | | | | |
|---|---|---|---|---|
| 6,716,353 | B1 * | 4/2004 | Mirzadeh | B01J 20/285 423/6 |
| 6,878,183 | B2 | 4/2005 | Soeda et al. | |
| 7,244,403 | B1 | 7/2007 | Maloney et al. | |
| 8,668,785 | B2 | 3/2014 | Shindo et al. | |
| 9,816,156 | B2 | 11/2017 | Marx et al. | |
| 2007/0297554 | A1 | 12/2007 | Lavie et al. | |
| 2010/0260640 | A1 | 10/2010 | Shindo et al. | |

FOREIGN PATENT DOCUMENTS

| | | | |
|---|---|---|---|
| CN | 102230089 | A | 11/2011 |
| CN | 102719685 | A | 10/2012 |
| CN | 103718250 | A | 4/2014 |
| CN | 109082542 | A | 12/2018 |
| CN | 111440947 | B | 2/2022 |
| RU | 2542733 | C1 * | 2/2015 |
| RU | 2704005 | C1 | 10/2019 |
| WO | 2019106182 | A1 | 6/2019 |
| WO | 2021102167 | A1 | 5/2021 |

OTHER PUBLICATIONS

National Library of France, Gallica.bnf.fr/ BnF. "Weekly Minutes of the Sessions of the Academie des sciences/ published by the perpetual Secretaries" Session of Jun. 17, 1957.
Dash et al. Indirect Production of No Carrier Added (NCA) 177Lu from Irradiation of Enriched 176Yb: Options for Ytterbium/ Lutetium Separation, Current Radiopharmaceuticals, vol. 8, No. 2, 2015. pp. 107-118.
International Search Report and Written Opinion for application PCT/US2020/061332 mail date Mar. 11, 2021 (11 pages).
B. J. Beaudry & F. H. Spedding: "The Gd—Yb and Lu—Yb phase systems", Metallurgical and Materials Transactions B, vol. 5.7, No. 7, Nov. 30, 1973 (Nov. 30, 1973), New York, pp. 1631-1636, XP009529139, ISSN: 1543-1916, DOI: 10.1007/BF02646335.
Gschneider "The Application of Vacuum Metallurgy in the Purification of Rare-Earth Metals" No. IS-1195; CONF-650617-3. Ames Lab., Iowa State Univ. of Science and Tech., 1965, https://www.osti.gov/servlets/purl/4578286.
Zhuxian Qiu, "Nonferrous Metallurgy for Higher Education", p. 341, Metallurgical Industry Press, published on May 31, 1988.
Zuzana Dvorakova, "Production and chemical processing of Lu for nuclear medicine at the Munich research reactor FRM-II" Institut fur Radiochemie der Technischen Universitat Munchen, dissertation submitted Aug. 13, 2007.
Watanabe et al. "Production of highly purified no-carrier-added 177Lu for radioimmunotherapy", J Radioanal Nucl Chem (2015) 303, pp. 935-940.
International Search Report and Written Opinion dated Jun. 25, 2021, pertaining to Int'l Patent Application No. PCT/US2021/025439, 10 pgs.
Canadian Office Action dated Apr. 3, 2024, pertaining to CA Patent Application No. 3,174,318, 4 pgs.
Gupta. "Extractive Metallurgy of Rare Earths" 1-484. CRC Press. Web, Https://vector.umd.edu/images/links/Extractive_Metallurgy_of_Rare_Earths_Gupta.pdf. 2005; p. 22 paragraph 3, p. 28 paragraph 4, p. 29 paragraph 2, table 5.8.
Common Knowledge Evidence 2: Bingqian Wu, Rare Earth Metallurgy, Central South University Press, Sep. 30, 2001, p. 291.
Danielson, P. Sources of water in vacuum systems. R&D Magazine, Sep. 2000, reprinted in Normandale Community College website, https://www.normandale.edu/academics/degrees-certificates/vacuum-and-thin-filmtechnology/articles/sources-of-water-vapor-in-vacuums-systems.html. Accessed Jun. 3, 2025. (Year: 2000).
Third Party Observation Submitted in Application No. 21721690.2 dated Dec. 8, 2025 (57 pages with English translation).
Panteleev (RAP Conference Proceedings, vol. 4, pp. 18-22, DOI: 10.37392/RapProc.2019.05) Published Sep. 2019.
Ionov (Vacuum, Volumne 47, Nos. 6-8, pp. 679-883, DOI: 10:1016/0042-207X(96)00086-3) Published Jun. 1996.
Clifford et al. (Nuclear Instruments and Methods in Physics Research Section A; Accelerators, Spectrometers, Detectors and Associated Equipment, vol. 480, Issue 1, pp. 29-35, 10.1016/S0168-9002(01)02043-5) Published Mar. 11, 2002.
Beaudry and Gschneider (Handbook on the Physics and Chemistry of Rare Earths, North Holland Publishing, Amsterdam, 1978, pp. 173-232, Published 1978.
Gschneider (Preparation and Purification of Rare Earth Metals and Effect of Impurities on their Properties, Ames Laboratory and Department of Materials, Science and Engineering, Iowa State University, Ames, Iowa, Science and Technology of Rare Earth Materials, 1980, Academic Press, Inc., ISBN 02-12-675640-6; Published 1980.
Korean Office Action for Application No. 10-2022-7038341 dated Nov. 18, 2025 (17 pages with English translation).
Daane et al. (Distillation of Rare-Earth Metals, Proceedings of the Second Conference on Rare Earth Research, pp. 175-184, vol. 1, Edited by Joseph F. Nachman and Charles E. Lundin, Gordon and Breach Science Publishers; hereafter TP4) has a publication date between Sep. 24-27, 1961.
M. Jerab and K. Sakurai (Hexagonal Growth of Ytterbium Nanoparticles by N2 Gas Deposition; WDS'09 Proceedings of Contributed Papers, Part 111, pp. 142-150, ISBN 978-80-7378-103-3; hereafter TPS) has a publication date of 2009.
M. Jerab and K. Sakurai (X-Ray Analysis of Yb Ultra Thin Film: Comparison of Gas Deposition and Ordinary Vacuum Evaporation, Advances in X-Ray Chemical Analysis, Japan, 40, 2009; ISSN 0911-7806, pp. 291-298; hereafter TPG) has a publication date of 2009.
Kobisk (Review of Isotopes Target Program, Isotopes Development Center, Oct. 1963-Dec. 1964; Oak Ridge National Laboratory, Oak Ridge, Tennessee, pp. 1-39; hereafter TPIO) has a publication date of Sep. 14, 1965.
Kobisk and Adair (Nuclear Instruments and Methods, 167, 1979, pp. 153-160; hereafter TPII) has a publication year of 1979.
Third Party Observation Submitted in Application No. 20890923.7 dated Feb. 5, 2026 (23 pages with English translation).
Third Party Observation Submitted in Application No. 23836097.8 dated May 7, 2026 (32 pages with English translation).
Tarasov et al., "Production of No. Carrier Added Lutetium-177 by Irradiation of Enriched Ytterbium-176", (Current Radiopharmaceuticals), 2015, 8, pp. 95-106.
Dvorakova, (PHD Thesis Production and chemical processing of 177Lu for nuclear medicine at the Munich research reactor FRM-II, Technische Universitat Munchen, 2007. Publication date of Sep. 20, 2007.
Xiaowei et al. "Preparation of High Purity Rare Earth Metals of Samarium Ytterbium and Thulium", (Rare Metal Materials and Engineering, vol. 45, issue 11, 2016, 2793-2797, has a publication date of Nov. 2016.
Kuznetsov et al., "Production of Lutetium-177: Process Aspects", (Radiochemistry vol. 61, No. 4, 381-395), 2019.
Third Party Observation Submitted in Application No. 23863754.0 dated Feb. 5, 2026 (302 pages with English translation).
Wikipedia Webpage, "Atmosphere of Earth" (https://en.wikipedia.org/wiki/Atmosphere_of_Earth) as of Nov. 27, 2015.

(56) References Cited

OTHER PUBLICATIONS

Japanese Office Action dated Jan. 26, 2026 relating to JP Patent Application No. 2022-559979.
Non-Final Office Action dated Apr. 1, 2026, relating to U.S. Appl. No. 18/504,730, filed Nov. 8, 2023.

* cited by examiner

SEPARATION OF RARE EARTH ELEMENTS

CROSS-REFERENCE TO RELATED APPLICATIONS

This application is a continuation of U.S. patent application Ser. No. 17/995,118 filed on Sep. 30, 2022 that is a national stage entry of PCT/US2021/025439 filed on Apr. 1, 2021, which claims the benefit of U.S. Provisional Application No. 63/004,332 filed on Apr. 2, 2020, the contents of which are incorporated herein by reference in there entireties.

FIELD

The present technology is generally related to the separation of rare earth elements and their purification. More particularly, it is related to the isolation and purification of lutetium from an irradiation target that includes other rare earth metals, such as ytterbium.

SUMMARY

In one aspect, a method for purifying lutetium is provided, the method includes providing a solid composition having ytterbium and lutetium therein, and subliming or distilling the ytterbium from the solid composition at a reduced pressure and at a temperature of about 400° C. to about 3000° C. to leave a lutetium composition comprising a higher weight percentage of lutetium than was present in the solid composition (i.e. a lutetium-enriched composition or sample). In some embodiments, the temperature may be about 450° C. to about 1500° C. In any of the above embodiments, the reduced pressure may be about $1\times10^{-8}$ to about 750 torr. In any of the above embodiments, the subliming or distilling may be conducted at a rate of about 10 min/g to about 100 min/g of solid composition. In any of the above embodiments, the solid composition may include Yb-176 and Lu-177.

In another aspect, a method includes subjecting a sample comprising Yb-176 and Lu-177 to sublimation, distillation, or a combination thereof to remove at least a portion of the Yb-176 from the sample to form a Lu-177 enriched sample.

In any of the above methods, the method may further include subjecting the lutetium composition or the lutetium-enriched sample to chromatographic separation to further enrich the lutetium in the composition or sample. In any of the above embodiments, the chromatographic separation may include column chromatography, plate chromatography, thin cell chromatography, or high-performance liquid chromatography.

In any of the above methods, the method may further include dissolving the lutetium composition or lutetium-enriched sample in an acid to form a dissolved lutetium solution, adding a chelator to the dissolved lutetium solution and neutralizing with a base to form a chelated lutetium solution comprising both chelated lutetium and ytterbium, and subjecting the chelated lutetium solution to chromatographic separation, collecting a purified, chelated lutetium fraction, and de-chelating the lutetium to obtain purified lutetium. In any of the above embodiments, the purified lutetium may include Lu-177 that is greater than 99% pure on an isotopic basis, greater than 99.9% pure on an isotopic basis, greater than 99.99% pure on an isotopic basis, greater than 99.999% pure on an isotopic basis, or greater than 99.9999% pure on an isotopic basis.

DETAILED DESCRIPTION

Figure 1:
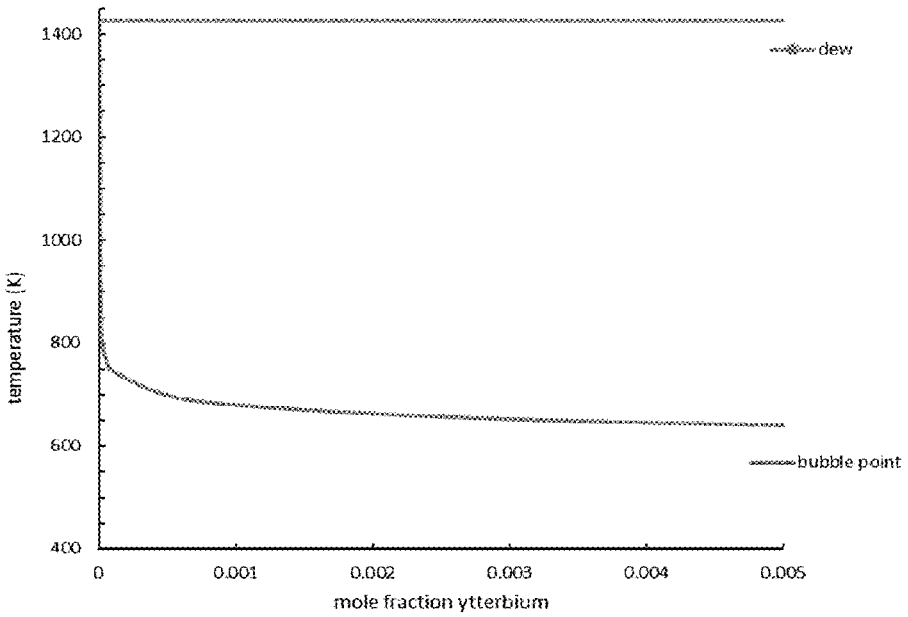
FIG. 1 is a T-x-y diagram for lutetium and ytterbium at a constant pressure of 1 μTorr.

Various embodiments are described hereinafter. It should be noted that the specific embodiments are not intended as an exhaustive description or as a limitation to the broader aspects discussed herein. One aspect described in conjunction with a particular embodiment is not necessarily limited to that embodiment and can be practiced with any other embodiment(s).

As used herein, "about" will be understood by persons of ordinary skill in the art and will vary to some extent depending upon the context in which it is used. If there are uses of the term which are not clear to persons of ordinary skill in the art, given the context in which it is used, "about" will mean up to plus or minus 10% of the particular term.

The use of the terms "a" and "an" and "the" and similar referents in the context of describing the elements (especially in the context of the following claims) are to be construed to cover both the singular and the plural, unless otherwise indicated herein or clearly contradicted by context. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the embodiments and does not pose a limitation on the scope of the claims unless otherwise stated. No language in the specification should be construed as indicating any non-claimed element as essential.

Lutetium-177 (Lu-177) is used in the treatment of neuro endocrine tumors, prostate, breast, renal, pancreatic, and other cancers. In the coming years, approximately 70,000 patients per year will need no carrier added Lu-177 during their medical treatments. Lu-177 is useful for many medical applications, because during decay it emits a low energy beta particle that is suitable for treating tumors. It also emits two gamma rays that can be used for diagnostic testing. Isotopes with both treatment and diagnostic characteristics are termed "theranostic." Not only is Lu-177 theranostic, it also has a 6.65-day half-life, which allows for more complicated chemistries to be employed, as well as allowing for easy global distribution. Lu-177 also exhibits chemical properties that allow for binding to many bio molecules, for use in a wide variety of medical treatments.

There are two main production pathways to produce Lu-177. One is via a neutron capture reaction on Lu-176; Lu-176 (n,γ) Lu-177. This production method is referred to as carrier added (ca) Lu-177. A carrier is an isotope(s) of the same element (Lu-176 in this case), or similar element, in the same chemical form as the isotope of interest. In microchemistry the chemical element or isotope of interest does not chemically behave as expected due to extremely low concentrations. In addition to this, isotopes of the same element cannot be chemically separated, and require mass separation techniques. The carrier method, therefore, results in the produced Lu-177 having limited medical application.

The second production method for Lu-177 is a neutron capture reaction on ytterbium-176 (Yb-176) (Yb-176(n,γ) Yb-177) to produce Yb-177. Yb-177 then rapidly ($t_{1/2}$ of 1.911 hours) beta-decays into Lu-177. An impurity of Yb-174 is typically present in the Yb-176, leading to a further impurity of Lu-175 in the final product. This process is considered to be a "no carrier added" process. The process may be carried out as ytterbium metal or ytterbium oxide.

The present disclosure describes a process for the separation of Yb and Lu obtained from a no carrier added process. The process includes a distillation/sublimation process to purify the lutetium and remove excess Yb after irradiation. The process may then also include further purification of the lutetium using a chromatographic separation process. Due to the limited amounts of material that may be processed at any one time during the chromatographic separation, the process of enriching the Lu prior to chromatographic separation allows for scaling of the recovery of the product Lu at a much greater level than previously obtainable. For example, the current process for chromatographic separation by itself is limited to 20 milligram targets per pass, with each pass taking 30 minutes to 1 hour of processing time. The combined distillation/sublimation and chromatographic separation allows for use of larger targets, and isolation of the product via distillation that can then be passed to the chromatographic process. Processing a 20 gram sample with chromatography alone would require 1000 batches, and significant loss of material.

The separation of Yb and Lu may, at least partially, take advantage of the difference in their vapor pressure at a particular temperature and pressure. As an example, the boiling point of Yb is 1196° C., while that of Lu is 3402° C. at standard temperature and pressure. The difference in vapor pressures at a specified temperature and pressure can be used to separate Yb and Lu via sublimation and/or distillation. FIG. 1 is a T-x-y diagram for lutetium and ytterbium at a constant pressure of 1 μTorr. In the figure, the lower line (i.e. bubble point) represents the condensed phase composition at a given temperature, while the upper line (i.e. dew) represents the vapor phase. The graph was prepared using the Ideal gas and Ideal solution assumptions, which are valid in view of the low pressure, high temperature, and chemical similarity of the two components.

In sublimation, the solid phase of an element is converted directly to the gas phase via heating, and the gas phase can then be collected for later use. In distillation, the solid is heated to its boiling point (going through the liquid phase) and vaporized off. The vaporized fraction can then be recovered downstream after the vapor is condensed. In this case, the ytterbium is vaporized (and it may be collected downstream for later use) leaving behind a material that is enriched in lutetium. This may be conducted on larger scale, therefore increasing the amount of lutetium available. It is noted that the Yb that is collected is available for recycling to the reactor to produce further Lu in subsequent runs of the process.

Figure 2:
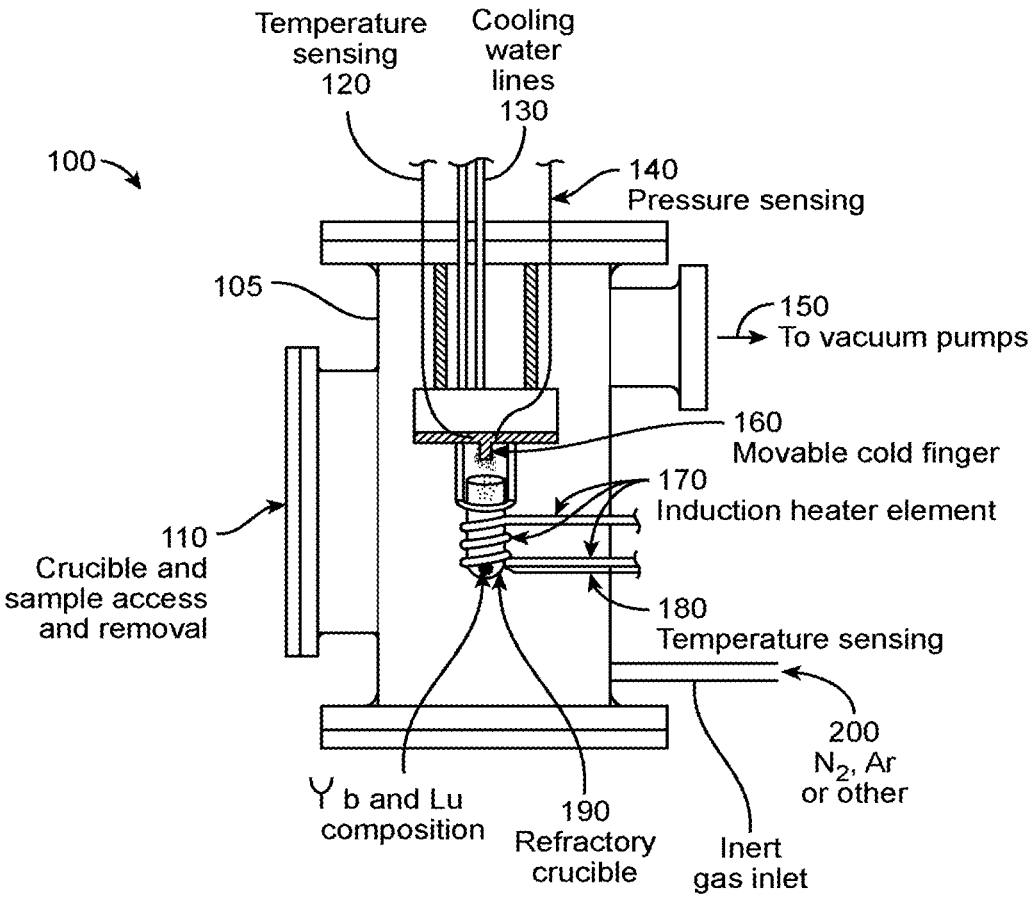
FIG. 2 is an illustration of chamber for distillation/sublimation of the ytterbium and lutetium.

The distillation/sublimation apparatus generally includes a high vacuum chamber with appropriate gas, cooling, vacuum, power and instrument feedthroughs. Referring to FIG. 2, the apparatus 100 has an appropriate volume to contain a refractory crucible 190 suspended or supported within an RF induction heating coil 170, and a cold-finger 160 with collection substrate. The cold finger (cooling rod) 160 with an appropriate end effector is disposed directly above the crucible 190 and is capable of movement which allows the open end of the crucible to be open to the vacuum system or sealed against the collection substrate. The apparatus has appropriate instrumentation to monitor the vacuum pressure of the chamber 140, the temperature of the crucible 180, and the temperature of the cold plate 120. The apparatus 100 is housed within a chamber 105 having an access port 110 to the crucible. The apparatus 100 also includes a vacuum pump connection 150 and at least one port 200 for inert gas introduction.

Generally, the process of the initial purification by distillation and/or sublimation proceeds as follows. An enriched Yb-176 metal target is packaged into a 1 cm diameter quartz tube with sealed ends. The quartz tube is then sealed in an inert overpack (e.g. aluminum) suitable for irradiation and impervious to water or air ingress. The sealed overpack is placed within the reactor and irradiated for several hours to several days (dependent on flux and batch requirements) to generate Lu-177 within the Yb-176 target. After irradiation, the irradiated Yb metal target is removed within an inert environment and placed inside a refractory metal crucible (e.g. molybdenum or tantalum), and placed in a vacuum chamber where the pressure is reduced. The crucible is then heated by radiofrequency (RF) induction. As the Yb metal sublimates from the heated crucible it is deposited onto the cold finger that is actively cooled for collection. As the sublimation advances, the crucible is heated to a higher temperature. At this stage of the process, the generated lutetium or lutetium oxide, minute quantities of ytterbium or ytterbium oxide, and trace contaminants remain in the crucible. The contents of the crucible, including the lutetium, are then dissolved in an acid to remove them from the crucible and for transfer to a chromatographic separation apparatus.

Accordingly, in a first aspect, a method is provided for purifying lutetium. The method includes providing a solid composition that include lutetium and ytterbium, and subliming or distilling ytterbium from the solid composition at a reduced pressure and at a temperature of about 400° C. to about 3000° C. to leave a lutetium composition comprising a higher weight percentage of lutetium than was present in the solid composition. As noted, the ytterbium that is sublimed/distilled from the solid composition may be recycled as additional target material for irradiation.

According to various embodiments, the temperature for sublimation and/or distillation may be from about 450° C. to about 1500° C., or from about 450° C. to about 1200° C. Also, according to various embodiments, the pressure may be from about $1\times10^{-8}$ to about 1520 torr. In other embodiments, the temperature may be from about 450° C. to about 1500° C. and the pressure from about 2000 torr to about $1\times10^{-8}$ torr; or the temperature may be from about 450° C. to about 1200° C., and the pressure about 1000 torr to about $1\times10^{-8}$ torr. In some embodiments, the separation includes distillation of the ytterbium from the solid composition, where the pressure may be from about 1 torr to about $1\times10^{-6}$ torr and the temperature about 450° C. to about 800° C. In some embodiments, the separation includes distillation of the ytterbium from the solid composition, where the pressure may be from about $1\times10^{-3}$ torr to about 1000 torr and the temperature about 600° C. to about 1500° C. In some embodiments, the separation includes distillation of the ytterbium from the solid composition, where the pressure may be from about $1\times10^{-6}$ torr to about 1×10−1 torr and the temperature about 470° C. to about 630° C.

In some embodiments, temperature ramp rates over a period of 10 minutes to 2 hours may be employed to ensure no blistering or uneven heating of the subject Yb sample containing the lutetium. The temperature of the sample may be monitored indirectly through the crucible. In other embodiments, prior to heating of the crucible a vacuum is established to degas the sample. This vacuum may be about $1\times10^{-6}$ torr for approximately 5 minutes to 1 hour. A turbomolecular pump may be used to achieve high vacuum levels.

The time period required for the subliming and/or distilling steps may vary widely and is dependent upon the amount of material in the sample, the temperature, and the pressure. It may vary from about 1 second to about 1 week. In some embodiments, it is a rate of sublimation or distillation that is pertinent to the question of time. It may, in some embodiments, be at a rate of about 10 min/g to about 100 min/g of solid composition, or about 20 min/g to about 60 min/g of solid composition. In one embodiment, the rate may be about 40 min/g of solid composition.

The sublimation/distillation process yields a sample ("the lutetium composition") that is enriched in lutetium as compared to the solid composition that enters the process. The yields and purity may be measured in a number of ways. For example, in some embodiments, the process yields an ytterbium mass reduction of the solid composition from 1000:1 to 10,000:1. In other words, after the sublimation/distillation is completed, there is 1000 to 10,000 times less ytterbium in the sample than prior to the process. In the lutetium composition that is recovered (i.e. the contents in the crucible that is subjected to the acid dissolution), there may, in some embodiments, be about 1 wt % to 90 wt % of ytterbium relative to total remaining mass that will then be separated as described below in a chromatographic process. In other embodiments, the ytterbium that is collected from the sublimation/distillation is collected in an amount that is about 90 wt % to about 99.999 wt % of the ytterbium present in the solid composition. The purification steps are also conducted to remove other trace metals and contaminants. For example, materials such as metals, metal oxides, or metal ions of K, Na, Ca, Fe, Al, Si, Ni, Cu, Pb, La, Ce, Lu (non-radioactive), Eu, Sn, Er, and Tm may be removed. Stated another way, a method includes subjecting a sample comprising Yb-176 and Lu-177 to sublimation, distillation, or a combination thereof to remove at least a portion of the Yb-176 from the sample and form a Lu-177-enriched sample.

It has been observed that a purification of greater than 1000:1 reduction (i.e. a 1000 times reduction in the amount of Yb present) in Yb may be achieved. This includes greater than approximately 3000:1, greater than 8000:1, greater than 10,000:1, up to and including approximately 40,000:1. However, higher reductions in Yb may be required to meet purity requirements for some pharmaceutical products. Accordingly, additional purification may be conducted prior to use in pharmaceutical applications. Such purification may be obtained through the use of chelators and/or chromatographic separation.

Any of the above lutetium compositions or lutetium-enriched samples, as described herein, may be subjected to chromatographic separation to further enrich the lutetium in the composition or sample. Such chromatographic separations may include column chromatography, plate chromatography, thin cell chromatography, or high-performance liquid chromatography. Illustrative processes for purification of lutetium may be as described in U.S. Pat. Nos. 7,244,403 and/or 9,816,156, all of which are incorporated herein by reference in their entirety.

In one aspect, a process may include dissolving in an acid the lutetium and ytterbium composition that remains in the crucible after sublimation and applying the resultant solution to a chromatographic column or plate. This may include plate chromatographic materials, chromatographic columns, HPLC chromatographic columns, ion exchange columns, and the like.

As an illustrative example, a solution of lutetium in dilute HCl may be prepared (i.e. 0.01-5 N HCl). This may be applied to a solution packed, or dry, ion exchange column, and the lutetium eluted with additional washes of dilute HCl. This is generally described by U.S. Pat. No. 7,244,403 as that the solution susceptible to treatment is generally a dilute solution of a strong acid, usually HCl. The bed of resin which may be in the form of a strong anion exchange resin in a column and the contacting occurs by flowing the solution through the column. In some embodiments, the resin is a strongly basic anion exchange resin which is about 8% cross linked. First, an HCl solution is flowed through the column to form an HCl-treated column, then flowing an NaCl solution through the HCl treated column to form an NaCl treated column, and then flowing sterile water through the NaCl-treated column. These preparative steps assist in eluting a sterile, nonpyrogenic product. The resin may then be dried prior to application of the lutetium solution. In some embodiments, the anion exchange resin is in a powdered form, generally having particles in the size of about 100 to about 200 mesh. To speed solution flow though the column, a sterile gas pressure may be applied to the head of the column. This can be carried out by injecting a sterile gas, preferably air, into an upper end of the column to push the solution of Lutetium 177 through the column. The lutetium-177 recovered from such a process may be in a higher purity than prior to the column chromatography through the anion exchange column.

In another aspect, a process may include the use of a cation exchange resin for the purification of lutetium from a composition that also include ytterbium. As an illustrative example, and as generally described by U.S. Pat. No. 9,816,156, the method includes loading a first column packed with cation exchange material, with the Lu/Yb mixture is dissolved in a mineral acid, exchanging the protons of the cation exchange material for ammonium ions, thereby using an $NH_4Cl$ solution, and washing the cation exchange material of the first column with water. An outlet of the first column is linked with the inlet of a second column that is also packed with a cation exchange material. A gradient of water and a chelating agent is then applied to the column starting at 100% of $H_2O$ to 0.2 M of the chelating agent on the inlet of the first column, so as to elute the lutetium from the first and second column. Illustrative examples of chelators include, but are not limited to, α-hydroxyisobutyrate [HIBA], citric acid, citrate, butyric acid, butyrate, EDTA, EGTA and ammonium ions. The method may also include determining the radioactivity dose on the outlet of the second column in order to recognize the elution of Lu-177 compounds; and collecting a first Lu-177 eluate from the outlet of the second column in a vessel, followed by protonating the chelating agent so as to inactivate same for the complex formation with Lu-177. The method may also include loading a final column packed with a cation exchange material by continuously conveying the acidic lutetium eluate to the inlet of the final column, washing out the chelating agent with diluted mineral acid of a concentration lower than approximately 0.1 M, removing traces of other metal ions from the lutetium solution by washing the cation exchange material of the final column with mineral acid of various concentrations in a range of approximately 0.01 to 2.5 M; and eluting the Lu-177 ions from the final column by way of a highly concentrated mineral acid of approximately 1M to 12M. Finally, an eluent containing higher purity lutetium than what was applied to the columns may be collected, and the solvent and mineral acid removed by vaporization.

In a further aspect, a process may include dissolving the lutetium and ytterbium composition or lutetium-enriched sample in an acid to form a dissolved lutetium/ytterbium solution, adding a chelator to the dissolved lutetium/ytterbium solution and neutralizing with a base to form a chelated lutetium/ytterbium solution comprising both chelated lutetium and ytterbium, and subjecting the chelated solution to chromatographic separation, collecting a purified, chelated lutetium fraction, and de-chelating the lutetium to obtain purified lutetium. The purified, chelated lutetium fraction has a purity of lutetium higher than that of the lutetium in the dissolved lutetium/ytterbium solution. Using such a chromatographic process high levels of lutetium purity may be obtained. For example, the purified lutetium obtained after chromatographic separation and work-up may include Lu-177 that is greater than 99% pure on an isotopic basis. This includes Lu-177 that is greater than 99.9%, greater than 99.99%, greater than 99.999%, or greater than 99.9999% pure on an isotopic basis.

Generally, a ytterbium metal or metal oxide target is irradiated to form Lu-177. The target is then dissolved in an acid, a chelator is added, and the solution neutralized with a base to form a chelated metal, chromatographic separation is conducted, and the purified metal is then decomplexed/de-chelated from the chelator. However, due to the limits of chromatography, by starting with an impure source of lutetium (i.e. the irradiated ytterbium oxide target), the efficiency of the chromatography is low, with only small fractions of purified lutetium being obtained with each chromatographic cycle, even on a preparative scale. Using the purified lutetium after distillation/sublimation, as described above, provides a surprising benefit in producing higher purity rare earth metals, particularly lutetium, that are not obtainable by either distillation or chromatography alone, on a larger scale, and in a shorter period of time.

The initial dissolution in an acid of the lutetium may be conducted using hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof. A concentration of the acid may be from about 0.01 M to about 6 M and/or a concentration of the base is from about 0.01 M to about 6 M. This includes concentrations of about 1 M to about 6 M and about 2 M to about 6 M. The chelator, vide infra, is then added along with a base (e.g. lithium hydroxide, sodium hydroxide, potassium hydroxide, $NH_4OH$, or an alkylammonium hydroxide) to neutralize the acid an produce the chelated lutetium. HPLC is then conducted. The HPLC may be conducted on a appropriate column and eluted with an appropriate mobile phase, each of which may change under different method development scenarios. As one example, the column may be a cation exchange column, an anion exchange column, a reversed phase C18 column, and the like and the mobile phase may any that is determined to achieve separation. The mobile phase may be aqueous- or organic solvent-based. Illustrative examples include, but are not limited to water, alcohols, alkanes, ethers, esters, acids, bases, and aromatics. In various embodiments, the mobile phase may include water, methanol/water, methanol/trifluoroacetic acid/water, and/or methanol mobile phase.

After purification via HPLC (vide infra) of the chelated lutetium, there is a de-chelating process that is conducted to obtain the purified lutetium as a lutetium solution and/or ionic material. In some embodiments, the de-chelating includes contacting the purified, chelated lutetium fraction with an acid that is hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof. A concentration of the acid may be from about 0.01 M to about 6 M and/or a concentration of the base is from about 0.01 M to about 6 M. This includes concentrations of about 1 M to about 6 M and about 2 M to about 6 M.

As discussed above, the process described herein may be used for the separation of lutetium and ytterbium. However, it may be used to separate any of the rare earth, and/or actinide metals where there is a difference in boiling/sublimation point followed by further purification using the chromatographic separations in the presence of the various chelators. In the above chelators, rare earth elements that may be chelated for purification include cerium (Ce), dysprosium (Dy), erbium (Er), europium (Eu), gadolinium (Gd), holmium (Ho), lanthanum (La), lutetium (Lu), neodymium (Nd), praseodymium (Pr), promethium (Pm), samarium (Sm), scandium (Sc), terbium (Tb), thulium (Tm), ytterbium (Yb), and yttrium (Y). In some embodiments, the methods include the chromatographic separation of rare earth elements from a mixture of at least two metal ions, where at least one of them is Ce, Dy, Er, Eu, Gd, Ho, La, Lu, Nd, Pr, Pm, Sm, Sc, Tb, Tm, Yb or Y.

In one preferred embodiment, the chromatography is high-performance liquid chromatography (HPLC) performed using a stationary reversed phase, preferably selected from $C_1$-$C_{18}$, phenyl, pentafluorophenyl, $C_1$-$C_{18}$ alkyl-phenyl or polymer-based reversed phases, and a mobile phase consisting of water and 0-40% (vol.) of a water-miscible organic solvent. The organic solvent may be any one or more of methanol, ethanol, propanol, isopropanol, acetonitrile, acetone, N,N-dimethylformamide, dimethylsulfoxide, or tetrahydrofuran. The solvent may also include the mobile phase further containing up to 10% (w/w) of an ion-pairing additive consisting of a cationic part and an anionic part, wherein the cationic part is selected from the group comprising $H^+$, $Li^+$, $Na^+$, $K^+$, $Rb^+$, $Cs^+$, $NH_4^+$, $C_1$-$C_8$ tetraalkylammonium, and wherein the anionic part is selected from the group comprising $F^-$, $Cl^-$, $Br^-$, $I^-$, sulfate, hydrogen sulfate, nitrate, perchlorate, methanesulfonate, trifluoromethanesulfonate, ($C_2$-$C_{18}$ alkyl)sulfonate, formate, acetate, ($C_2$-$C_{18}$ alkyl)carboxylate, lactate, malate, citrate, 2-hydroxyisobutyrate, mandelate, diglycolate, tartarate.

The solution of metal chelates may optionally be centrifuged or filtered prior to the chromatography, in order to remove particulates, such as insoluble impurities or dust. The separation may be achieved via a variety of chromatographic arrangements including column chromatography, thin layer chromatography (TLC) and high-performance liquid chromatography (HPLC). In some embodiments, the chromatographic separation may be achieved using HPLC on a $C_8$, $C_{18}$, or phenyl-hexyl reversed phase. In some embodiments, a mobile phase may be used that is water and 3-40 vol % of methanol, ethanol, or acetonitrile. Optionally, 0.01-0.1 mol/L of a buffer may be used in the mobile phase, wherein the buffer comprises sodium acetate pH=4.5, ammonium formate pH=7.0 or ammonium acetate pH=7.0.

Fractions containing the desired metal chelate may be collected and combined, resulting in a solution significantly enriched in the content of the desired rare earth metal chelate compared to the original mixture of metal chelates prior to the chromatography. The process may be repeated to further increase the purity of the product.

In an embodiment, the decomposition of the purified chelate is performed by treating of the solution of the chromatographically purified chelate with an organic or inorganic acid in order to achieve decomplexation of the metal ion from the chelate. The organic or inorganic acid may be hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof. In some embodiments, the decomplexation/de-chelation is achieved by using HCl (0.01-12 mol/L) at 25° C. to 95° C. for time period of 5 minutes to 24 hours. A secondary chromatographic purification may then performed to remove the free chelator molecule from rare earth metal ions. This may be achieved by a column chromatography or solid-phase extraction using a stationary reversed phase. The chelator may be retained on the reversed phase, while the free metal ions are eluted in the form of a salt with the acid used in decomposition of the chelate.

The increase in concentration of the combined fractions containing the metal chelate being separated before repetition of the chromatographic separation may be achieved by partial evaporation of the solvent or by adsorption of the chelate to lipophilic materials, such as a reversed phase. In some embodiments, the same reverse phase is used as for the chromatographic separation. When aqueous solution of the chelate is brought to physical contact with the reversed phase, it results in adsorption of the chelate. The chelate may then be desorbed from the reversed phase with a stronger eluent, wherein the stronger eluent contains higher percentage of a water-miscible organic solvent than the original solution of the chelate, wherein the water-miscible organic solvent is methanol, ethanol, propanol, isopropanol, acetone, acetonitrile, N,N-dimethylformamide, dimethylsulfoxide, tetrahydrofuran, or a mixture of any two or more thereof. The strength of the eluent is controlled by the percentage of the water-miscible organic solvent in the mobile phase.

In the described process, the Yb metal that is collected from the distillation/sublimation process is available for reuse (i.e. recycled for irradiation) almost immediately, whereas if a chelation only process was used for the separation, the Yb ions from the chelation would need to be separated from the solvents and chelates, and then converted to a suitable form for reactor irradiation, such as oxide or metal. Accordingly, the process provides a more streamlined, and environmentally friendly process with recycling of the input materials being readily obtained.

In general, "substituted" refers to an alkyl, alkenyl, alkynyl, aryl, or ether group, as defined below (e.g., an alkyl group) in which one or more bonds to a hydrogen atom contained therein are replaced by a bond to non-hydrogen or non-carbon atoms. Substituted groups also include groups in which one or more bonds to a carbon(s) or hydrogen(s) atom are replaced by one or more bonds, including double or triple bonds, to a heteroatom. Thus, a substituted group will be substituted with one or more substituents, unless otherwise specified. In some embodiments, a substituted group is substituted with 1, 2, 3, 4, 5, or 6 substituents. Examples of substituent groups include: halogens (i.e., F, Cl, Br, and I); hydroxyls; alkoxy, alkenoxy, alkynoxy, aryloxy, aralkyloxy, heterocyclyloxy, and heterocyclylalkoxy groups; carbonyls (oxo); carboxyls; esters; urethanes; oximes; hydroxylamines; alkoxyamines; aralkoxyamines; thiols; sulfides; sulfoxides; sulfones; sulfonyls; sulfonamides; amines; N-oxides; hydrazines; hydrazides; hydrazones; azides; amides; ureas; amidines; guanidines; enamines; imides; isocyanates; isothiocyanates; cyanates; thiocyanates; imines; nitro groups; nitriles (i.e., CN); and the like.

As used herein, "alkyl" groups include straight chain and branched alkyl groups having from 1 to about 20 carbon atoms, and typically from 1 to 12 carbons or, in some embodiments, from 1 to 8 carbon atoms. As employed herein, "alkyl groups" include cycloalkyl groups as defined below. Alkyl groups may be substituted or unsubstituted. Examples of straight chain alkyl groups include methyl, ethyl, n-propyl, n-butyl, n-pentyl, n-hexyl, n-heptyl, and n-octyl groups. Examples of branched alkyl groups include, but are not limited to, isopropyl, sec-butyl, t-butyl, neopentyl, and isopentyl groups. Representative substituted alkyl groups may be substituted one or more times with, for example, amino, thio, hydroxy, cyano, alkoxy, and/or halo groups such as F, Cl, Br, and I groups. As used herein the term haloalkyl is an alkyl group having one or more halo groups. In some embodiments, haloalkyl refers to a perhaloalkyl group.

Cycloalkyl groups are cyclic alkyl groups such as, but not limited to, cyclopropyl, cyclobutyl, cyclopentyl, cyclohexyl, cycloheptyl, and cyclooctyl groups. In some embodiments, the cycloalkyl group has 3 to 8 ring members, whereas in other embodiments the number of ring carbon atoms range from 3 to 5, 6, or 7. Cycloalkyl groups may be substituted or unsubstituted. Cycloalkyl groups further include polycyclic cycloalkyl groups such as, but not limited to, norbornyl, adamantyl, bornyl, camphenyl, isocamphenyl, and carenyl groups, and fused rings such as, but not limited to, decalinyl, and the like. Cycloalkyl groups also include rings that are substituted with straight or branched chain alkyl groups as defined above. Representative substituted cycloalkyl groups may be mono-substituted or substituted more than once, such as, but not limited to: 2,2-; 2,3-; 2,4-; 2,5-; or 2,6-disubstituted cyclohexyl groups or mono-, di, or tri-substituted norbornyl or cycloheptyl groups, which may be substituted with, for example, alkyl, alkoxy, amino, thio, hydroxy, cyano, and/or halo groups.

As used herein, "aryl", or "aromatic," groups are cyclic aromatic hydrocarbons that do not contain heteroatoms. Aryl groups include monocyclic, bicyclic and polycyclic ring systems. Thus, aryl groups include, but are not limited to, phenyl, azulenyl, heptalenyl, biphenylenyl, indacenyl, fluorenyl, phenanthrenyl, triphenylenyl, pyrenyl, naphthacenyl, chrysenyl, biphenyl, anthracenyl, indenyl, indanyl, pentalenyl, and naphthyl groups. In some embodiments, aryl groups contain 6-14 carbons, and in others from 6 to 12 or even 6-10 carbon atoms in the ring portions of the groups. The phrase "aryl groups" includes groups containing fused rings, such as fused aromatic-aliphatic ring systems (e.g., indanyl, tetrahydronaphthyl, and the like). Aryl groups may be substituted or unsubstituted. Heteroaryl groups are aryl groups that include a heteroatom in the ring.

The present invention, thus generally described, will be understood more readily by reference to the following examples, which are provided by way of illustration and are not intended to be limiting of the present invention.

EXAMPLES

General. Description of the sublimation/distillation apparatus. The apparatus includes a high vacuum chamber with appropriate gas, cooling, vacuum, power, and instrument feedthroughs. The apparatus has an appropriate volume to contain a refractory crucible suspended or supported within an RF induction heating coil, and a cold-surface with collection substrate. A cold finger (cooling rod) with an appropriate end effector is disposed directly above the crucible and is capable of movement which allows the open end of the crucible to be open to the vacuum system or sealed against the collection substrate. The apparatus has appropriate instrumentation to monitor the vacuum pressure of the chamber, the temperature of the crucible, and the temperature of the cold plate.

Description of the process of sublimation/distillation.

1. Enriched Yb-176 metal is packaged into a 1 cm diameter quartz vial with sealed ends, either evacuated or containing inert gas.
2. The quartz vial is sealed in an inert overpack (i.e. aluminum) suitable for irradiation and impervious to water or air ingress.
3. The sealed overpack is placed within the reactor and irradiated for several hours to several days (dependent on flux and batch requirements).
4. The overpack is removed from the reactor.
5. The transport cask is loaded into the processing hotcell or isolator.
6. The quartz vial with irradiated metal is opened, and the irradiated Yb metal target removed.
7. The irradiated Yb metal target is placed inside a refractory metal crucible (e.g. molybdenum or tantalum).
8. Under an inert atmosphere (e.g. He, $N_2$, Ar, etc.), the chamber is evacuated until a stable pressure of approximately $1\times10^{-6}$ torr is obtained.
9. The crucible is then heated by radiofrequency (RF) induction heating to approximately 470° C. At this temperature, the direct sublimation of Yb is indicated by a slight pressure rise within the vacuum chamber due to engineered leak paths for small amounts of Yb vapor. As the Yb metal sublimates from the heated crucible it is selectively deposited on to a cold finger which is actively cooled for collection and re-use at step 1.
10. Sublimation is allowed to continue for approximately 40 minutes per gram of starting material, and completion of the process is identified by an abrupt drop in vacuum pressure from about $5\times10^{-6}$ torr to less than about $1\times10^{-6}$ torr.
11. Following completion of sublimation, the crucible is heated further, to approximately 600° C. for 10 minutes. At this stage, only minute quantities of lutetium, minute quantities of ytterbium oxide, and trace contaminants remain in the crucible.
12. Dilute HCl (approximately 2 ml of approximately 2 M) is then added to the crucible to dissolve the remaining material, which is then removed by pipet or syringe and filtered with a 0.22 μm membrane as it is transferred into an HPLC system for chelation and separation.

Example 1. Illustrative example of the process. A quartz vial is loaded with $^{176}$Yb metal (10 g) and irradiated for 6 days thereby converting some of the $^{176}$Yb to $^{177}$Lu. The mixed $^{176}$Yb/$^{177}$Lu sample is then transferred to a crucible and loaded into a vacuum chamber. The crucible is then heated to 1000° C., at an external pressure of 1e-6 torr, for approximately 24 hours, during which time a portion of the $^{176}$Yb sublimes within the crucible onto a cold finger within the vacuum chamber and the $^{177}$Lu remains in the crucible. The $^{176}$Yb may then be recycled for further irradiation.

The $^{177}$Lu is then dissolved into 0.5 M to 6 M HCl. To the dissolved $^{177}$Lu is then added a chelator and NaOH is added to form chelated $^{177}$Lu at a neutral pH. The chelated $^{177}$Lu does contain other impurities at this point. For example, it will contain Yb, and it may contain K, Na, Ca, Fe, Al, Si, Ni, Cu, Pb, La, Ce, Lu (other than Lu-177), Eu, Sn, Er, and Tm. For further purification, the chelated $^{177}$Lu is then applied to a high performance liquid chromatography (HPLC) system (reversed phase C18 column with 12-14 vol % methanol) from which chelated $^{177}$Lu is then eluted at a higher purity then when it was applied to the column. Acidification with HCl of the chelated $^{177}$Lu releases it from the chelator as the chloride salt.

While certain embodiments have been illustrated and described, it should be understood that changes and modifications can be made therein in accordance with ordinary skill in the art without departing from the technology in its broader aspects as defined in the following claims.

The embodiments, illustratively described herein may suitably be practiced in the absence of any element or elements, limitation or limitations, not specifically disclosed herein. Thus, for example, the terms "comprising," "including," "containing," etc. shall be read expansively and without limitation. Additionally, the terms and expressions employed herein have been used as terms of description and not of limitation, and there is no intention in the use of such terms and expressions of excluding any equivalents of the features shown and described or portions thereof, but it is recognized that various modifications are possible within the scope of the claimed technology. Additionally, the phrase "consisting essentially of" will be understood to include those elements specifically recited and those additional elements that do not materially affect the basic and novel characteristics of the claimed technology. The phrase "consisting of" excludes any element not specified.

The present disclosure is not to be limited in terms of the particular embodiments described in this application. Many modifications and variations can be made without departing from its spirit and scope, as will be apparent to those skilled in the art. Functionally equivalent methods and compositions within the scope of the disclosure, in addition to those enumerated herein, will be apparent to those skilled in the art from the foregoing descriptions. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds, compositions or biological systems, which can of course vary. It is also to be understood that the terminology used herein is for the purpose of describing particular embodiments only, and is not intended to be limiting.

In addition, where features or aspects of the disclosure are described in terms of Markush groups, those skilled in the art will recognize that the disclosure is also thereby described in terms of any individual member or subgroup of members of the Markush group.

As will be understood by one skilled in the art, for any and all purposes, particularly in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. As will also be understood by one skilled in the art all language such as "up to," "at least," "greater than," "less than," and the like, include the number recited and refer to ranges which can be subsequently broken down into subranges as discussed above. Finally, as will be understood by one skilled in the art, a range includes each individual member.

All publications, patent applications, issued patents, and other documents referred to in this specification are herein incorporated by reference as if each individual publication, patent application, issued patent, or other document was specifically and individually indicated to be incorporated by reference in its entirety. Definitions that are contained in text incorporated by reference are excluded to the extent that they contradict definitions in this disclosure.

Other embodiments are set forth in the following claims.

What is claimed is:

1. A method for purifying lutetium, the method comprising:

reducing ytterbium oxide to ytterbium metal;

irradiating the ytterbium metal to generate lutetium, thereby forming a solid composition comprising ytterbium and lutetium;

subliming or distilling the ytterbium metal from a solid composition comprising ytterbium and lutetium in an inert or reduced pressure environment to leave a lutetium composition comprising a higher weight percentage of lutetium than was present in the solid composition;

chelating the lutetium composition with a chelator to form a chelated lutetium solution comprising both chelated lutetium and ytterbium;

subjecting the chelated lutetium solution to chromatographic separation;

collecting a purified, chelated lutetium fraction; and de-chelating the lutetium to obtain the purified lutetium.

2. The method of claim 1, wherein chelating the lutetium composition comprises dissolving the lutetium composition in an acid to form a dissolved lutetium solution, adding the chelator to the dissolved lutetium solution and neutralizing with a base to form the chelated lutetium solution comprising both chelated lutetium and ytterbium.

3. The method of claim 2, wherein the purified, chelated lutetium fraction has a purity of lutetium higher than that of the lutetium in the dissolved lutetium solution.

4. The method of claim 1, wherein chelating the lutetium composition comprises loading the lutetium composition into a column that houses a cation exchange material and directing the chelator and water into the column to form the chelated solution comprising both chelated lutetium and ytterbium.

5. The method of claim 1, wherein the chromatographic separation comprises column chromatography, plate chromatography, thin cell chromatography, or high-performance liquid chromatography.

6. The method of claim 1, wherein the de-chelating comprises contacting the purified, chelated lutetium fraction with an acid that is hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof.

7. The method of claim 1, wherein the ytterbium is collected in an amount that is 90 wt % to 99.999 wt % of the ytterbium present in the solid composition.

8. The method of claim 1, wherein the purified lutetium comprises Lu-177 that is greater than 99% pure on an isotopic basis.

9. The method of claim 1, further comprising collecting the ytterbium for reuse.

10. The method of claim 1, wherein subliming or distilling the ytterbium metal from the solid composition is conducted at a temperature of 400° C. to 3000° C.

11. The method of claim 1, wherein the reduced pressure is 100 torr to $1\times10^{-7}$ torr.

12. The method of claim 1, wherein subliming or distilling the ytterbium metal from the solid composition is conducted at a temperature of 400° C. to less than 700° C. and the reduced pressure is $1\times10^{-3}$ torr or less.

13. The method of claim 1, wherein subliming or distilling the ytterbium metal from the solid composition is conducted at a temperature of 400° C. to 1500° C. and the reduced pressure is 10 torr to $1\times10^{-6}$ torr.

14. The method of claim 1, wherein the reduced pressure is $1\times10^{-3}$ torr or less.

15. The method of claim 1, wherein the reduced pressure is $1\times10^{-4}$ torr or less.

16. The method of claim 1, wherein subliming or distilling the ytterbium metal from the solid composition is conducted at a temperature of 400° C. to 1500° C.

17. The method of claim 1, wherein subliming or distilling the ytterbium metal from the solid composition is conducted at a temperature of 400° C. to 1200° C.

18. The method of claim 1, wherein subliming or distilling the ytterbium metal from the solid composition is conducted at a temperature of 800° C. to 3000° C.

19. The method of claim 1, wherein the ytterbium is solid ytterbium-176 (Yb-176) and the lutetium is solid lutetium-177 (Lu-177), and a neutron capture reaction with Yb-176 forms the solid composition comprising the solid Yb-176 and the solid Lu-177.

20. A method for purifying lutetium, the method comprising:

subliming or distilling ytterbium from a solid composition comprising ytterbium and lutetium in an environment comprising a pressure of $1\times10^{-3}$ torr or less and at a temperature of 400° C. to less than 700° C. to leave a lutetium composition comprising a higher weight percentage of lutetium than was present in the solid composition;

chelating the lutetium composition with a chelator to form a chelated lutetium solution comprising both chelated lutetium and ytterbium;

subjecting the chelated lutetium solution to chromatographic separation;

collecting a purified, chelated lutetium fraction; and de-chelating the lutetium to obtain the purified lutetium; wherein:

the purified lutetium comprises Lu-177 that is greater than 99% pure on an isotopic basis; and the ytterbium is collected in an amount that is 90 wt % to 99.999 wt % of the ytterbium present in the solid composition.

21. The method of claim 20, wherein chelating the lutetium composition comprises dissolving the lutetium composition in an acid to form a dissolved lutetium solution, adding the chelator to the dissolved lutetium solution and neutralizing with a base to form the chelated lutetium solution comprising both chelated lutetium and ytterbium.

22. The method of claim 21, wherein the purified, chelated lutetium fraction has a purity of lutetium higher than that of the lutetium in the dissolved lutetium solution.

23. The method of claim 20, wherein chelating the lutetium composition comprises loading the lutetium composition into a column that houses a cation exchange material and directing the chelator and water into the column to form the chelated solution comprising both chelated lutetium and ytterbium.

24. The method of claim 20, wherein the chromatographic separation comprises column chromatography, plate chromatography, thin cell chromatography, or high-performance liquid chromatography.

25. The method of claim 20, wherein the de-chelating comprises contacting the purified, chelated lutetium fraction with an acid that is hydrofluoric, hydrochloric, hydrobromic, hydroiodic, sulfuric, nitric, peroxosulfuric, perchloric, methanesulfonic, trifluoromethanesulfonic, formic, acetic, trifluoroacetic acid, or a mixture of any two or more thereof.

26. The method of claim 20, further comprising collecting the ytterbium for reuse.

27. The method of claim 20, wherein the pressure in the environment is $1\times10^{-4}$ torr or less.

28. The method of claim 20, wherein the ytterbium is solid ytterbium-176 (Yb-176) and the lutetium is solid lutetium-177 (Lu-177), and a neutron capture reaction with Yb-176 forms the solid composition comprising the solid Yb-176 and the solid Lu-177.

29. The method of claim 20, wherein the temperature is 400° C. to 650° C. and the pressure in the environment is $1\times10^{4}$ torr or less.

30. The method of claim 20, wherein the temperature is 470° C. to 630° C. and the pressure in the environment is $1\times10^{-4}$ torr or less.

* * * * *